US006671907B1

(12) United States Patent
Zuberi

(10) Patent No.: US 6,671,907 B1
(45) Date of Patent: Jan. 6, 2004

(54) SLEEP APNEA AVOIDANCE PROCESS AND APPARATUS

(76) Inventor: Najeeb Zuberi, 391 Augustine Ct., Oviedo, FL (US) 32765

( * ) Notice: Subject to any disclaimer, the term of this patent is extended or adjusted under 35 U.S.C. 154(b) by 0 days.

(21) Appl. No.: 10/412,873

(22) Filed: Apr. 15, 2003

(51) Int. Cl.[7] ..... A47G 9/00
(52) U.S. Cl. ..... 5/636; 5/646; 128/845
(58) Field of Search ..... 5/636, 646, 638, 5/639, 644, 632; 128/845; D6/601

(56) References Cited

U.S. PATENT DOCUMENTS

| | | | | | |
|---|---|---|---|---|---|
| D215,536 | S | | 10/1969 | Larsen | |
| 3,694,831 | A | | 10/1972 | Treace | |
| 3,883,906 | A | * | 5/1975 | Sumpter | 5/632 |
| D236,062 | S | | 7/1975 | Winston | |
| 4,118,813 | A | | 10/1978 | Armstrong | |
| D282,803 | S | | 3/1986 | Righini | |
| 5,214,814 | A | * | 6/1993 | Eremita et al. | 5/646 |
| D340,380 | S | | 10/1993 | McDonald | |
| 5,269,035 | A | | 12/1993 | Hartunian | |
| D343,754 | S | | 2/1994 | Pierce et al. | |
| 5,579,551 | A | | 12/1996 | Tommaney | |
| 5,604,944 | A | * | 2/1997 | Meade | 5/636 |
| 5,644,809 | A | * | 7/1997 | Olson | 5/636 |
| D414,974 | S | | 10/1999 | Marrone, II et al. | |
| 6,128,797 | A | | 10/2000 | Shaffer | |
| D441,823 | S | | 5/2001 | Blackhurst | |
| D442,006 | S | | 5/2001 | Miller | |
| D471,050 | S | * | 3/2003 | Haubner | D6/601 |

* cited by examiner

*Primary Examiner*—Alexander Grosz
(74) *Attorney, Agent, or Firm*—William M. Hobby, III

(57) ABSTRACT

A sleep apnea avoidance process includes selecting a pillow having a pair of sides, angled at a predetermined angle and shaped to hold a person's head face down on one side thereof. The selected pillow has a pair of arm openings thereunder to position a person's arm to assist in holding a person's head face down on the pillow angle side such that the user can use one or the other arms when placing the head on one or the other angled side of the pillow. The process includes resting on one of the pillow's angled sides with one arm placed through the arm opening whereby jaw movement and sleep apnea are avoided.

3 Claims, 2 Drawing Sheets

SLEEP APNEA AVOIDANCE PROCESS AND APPARATUS

BACKGROUND OF THE INVENTION

The present invention relates to a sleep apnea avoidance process and apparatus and especially to a sleep apnea avoidance process utilizing a pillow shaped to hold the face of a person resting on the pillow facing downwards at a predetermined angle.

There are several types of sleep apnea but in each type people with untreated sleep apnea stop breathing repeatedly during their sleep. In sleep apnea, a person's brain will briefly arouse the person from sleep in order for them to resume breathing. This results in a fragmented and poor quality sleep. An untreated sleep apnea can cause cardiovascular disease, memory problems, weight gain, stroke, headaches and high blood pressure. Sleep apnea is very common in the U.S. and can occur at any age but special risk factors include being male, overweight, and over forty years old.

In the past, there have been a great variety of pillow shapes for positioning a person's head in a predetermined position for a variety of reasons. The U.S. Patent to Shaffer No. 6,128,797 is for a face down tanning and massage pad made of an inflatable plastic or rubber material or solid foam material with a center opening and ventilation for holding a person's head in a downward position. The Armstrong U.S. Pat. No. 4,118,813 is a sleep training pillow for the prevention of snoring and is designed to train a person to sleep in a position which prevents snoring. The pillow has a pillow support surface and a face support surface. The face support surface is inclined downward from a high end to a low end and a relief cavity is cut out near the low end of the pillow. In the Tommaney U.S. Pat. No. 5,579,551, an arched shape pillow apparatus is provided with an ear accommodation. In the Hartunian U.S. Pat. No. 5,269,035, a head support for a person lying in a prone position is provided which supports the patient's head at the chin and forehead and includes a side opening for an anesthetist to view a patient's face for passage of an endotracheal or other tube used during surgery. The Treace U.S. Pat. No. 3,694,831 shows a medical head support for a variety of uses in hospitals. The pillow has two inwardly angled portions along with a cutout and a hole to position the head facing upward or downward or to one side. A variety of U.S. design patents include many different shaped pillows, many with angled sides including the Larsen patent No. D215,536 for a Pillow and the Winston patent No. D236,062 for a Face Pillow and the Righini patent No. D282,803 for a Head Rest. Other U.S. design patents include the McDonald D340,380 for a Pillow for Separating Knees and the Pierce et al. design patent D343,754 for a Pyramid Shaped Pillow Set and the Marrone, II et al. design patent D414,974 for a Face Down Cushion. Other U.S. design patents include the Blackhurst patent No. D441,823 for a Practice Platform and the Miller U.S. Patent D442,006 for an Assembly of Pregnancy Support Pillows.

The present invention is directed towards a sleep apnea avoidance process and apparatus which supports the head in a position to keep the jaw from moving back with the head supported face down on the pillow and held in place by gravity and by the positioning of the arm through an arm cutout.

SUMMARY OF THE INVENTION

A sleep apnea avoidance process includes selecting a pillow having a pair of sides, each angled at a predetermined angle and shaped to hold a person's head face down on one side thereof. The selected pillow has a pair of arm openings thereunder to position a person's arm to assist in holding a person's head face down on the pillow angle side such that the user can use one or the other arms when placing the head on one or the other angled side of the pillow. The process includes resting on one of the pillow's angled sides with one arm placed through the arm opening whereby jaw movement and sleep apnea are avoided.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENTS

Figure 1:
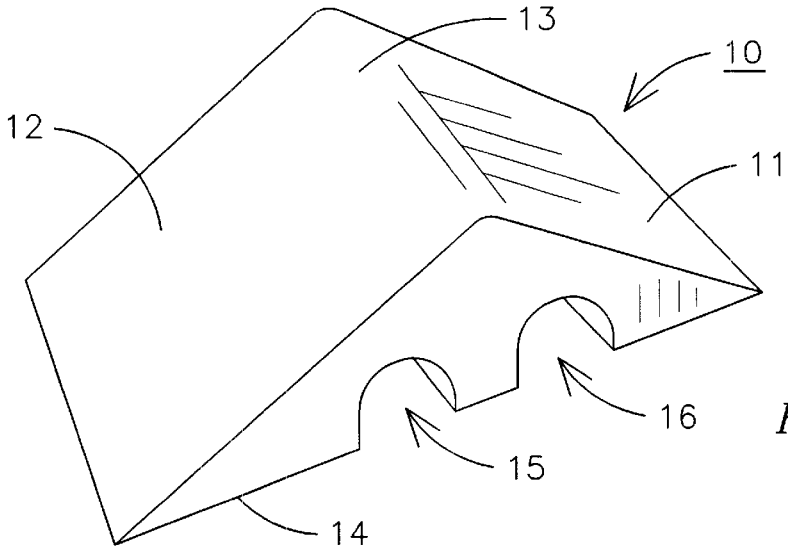
FIG. 1 is a perspective view of a sleep apnea avoidance pillow in accordance with the present invention.
Figure 2:
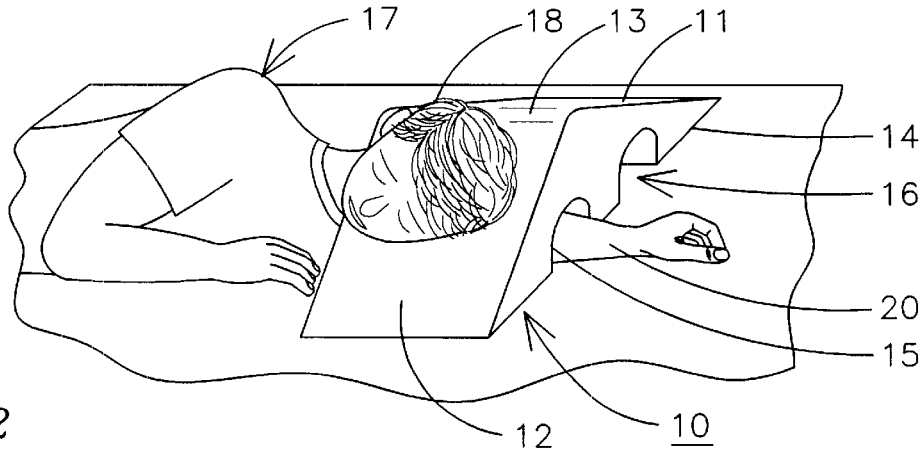
FIG. 2 is a perspective view of a person resting on the pillow of FIG. 1 facing in one direction.
Figure 3:
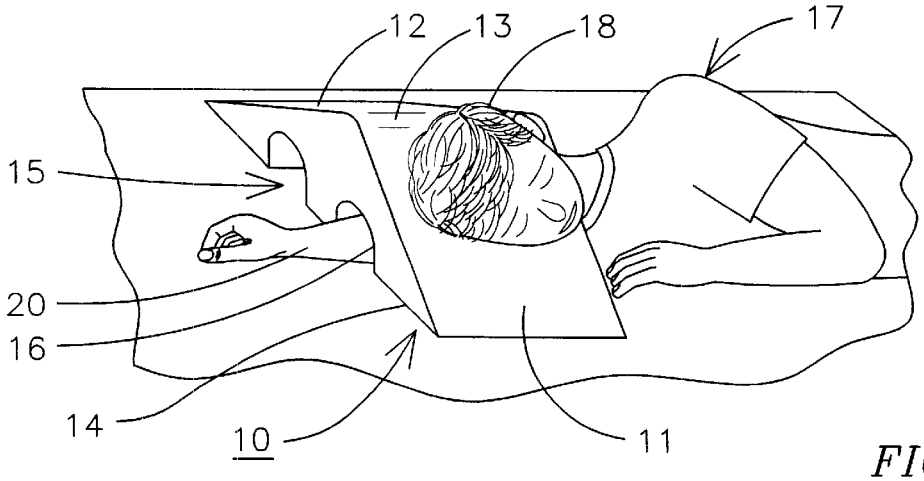
FIG. 3 is a perspective view of a person resting on the pillow of FIG. 1 facing the other direction from FIG. 2.

A process and apparatus for preventing sleep apnea by holding the head in a predetermined position while resting on the pillow to prevent the jaw from moving backwards is set forth as seen in FIGS. 1–3. In FIGS. 1–3, a sleep apnea avoidance pillow 10 may be made of any pillow material desired, such as a soft but firm polyurethane foam. The pillow includes an angled side 11 and an angled side 12 which may be angled at approximately 45 degrees from the base 14 and reaching an apex 13. The pillow base 14 has a pair of cutouts 15 and 16 for holding a person's arms. The cutouts 15 and 16 are positioned for holding one or the other arm, depending on whether the person is laying with his head face down on the angled side 11 or the angled side 12 as seen in FIGS. 2 and 3. An individual 17 has his head 18 positioned on the side 12 in FIG. 2 with his arm 20 passing through the opening 15 beneath the pillow while the person 17 has his head 18 with his face 21 resting on the pillow angled side 11 with his arm 20 passing through the opening 16 in FIG. 3. A person's head is supported by angled sides 11 and 12 in a downward position and is forced into this position by the position of the cutouts 15 and 16 which assist in holding the person's head in a downward position, as shown in FIGS. 2 and 3, when positioned at an angle of 45 degrees or thereabouts with the head facing downward. The jaw of the person 17 is prevented from moving backwards, that is when the person is sleeping on his back. The mouth is also kept in position by gravity and the angle of the jaw extends downwardly and thus avoids the obstruction in sleep apnea.

In the process, a person 17 selects a pillow in accordance with the pillow 10, positions the pillow on a bed or resting surface, positions his arm through one of the openings 15 or 16, with his head resting on either side 11 or 12 face downward in order to prevent or reduce sleep apnea in the individual.

Figure 4:
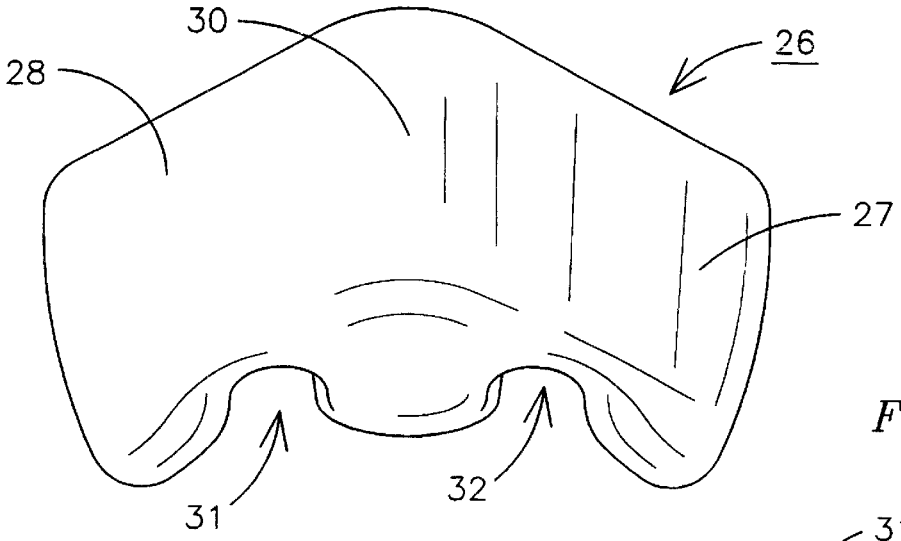
FIG. 4 is a perspective view of a modified embodiment of the pillow of FIGS. 1–3.
Figure 5:
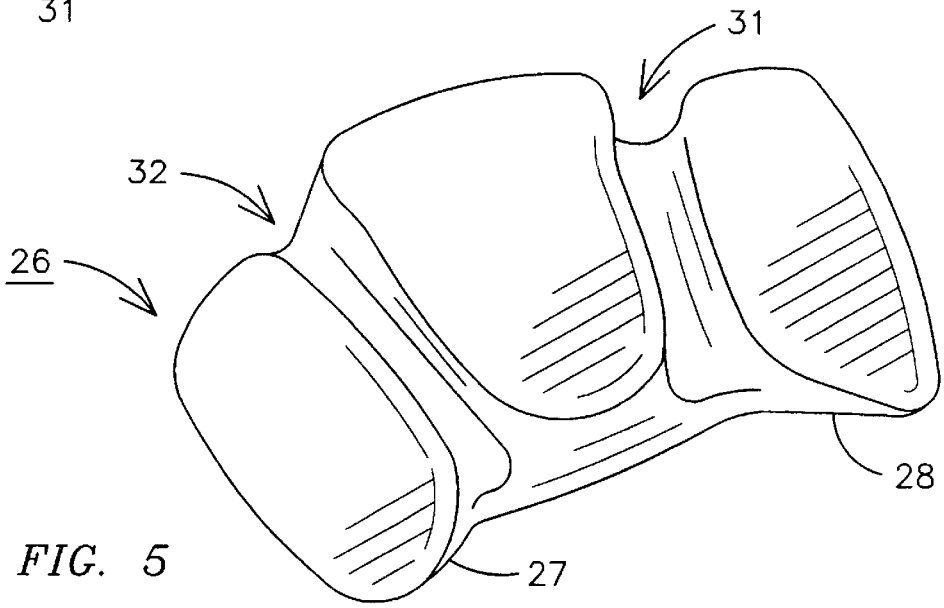
FIG. 5 is a bottom perspective view of the pillow of FIG. 4.
Figure 6:
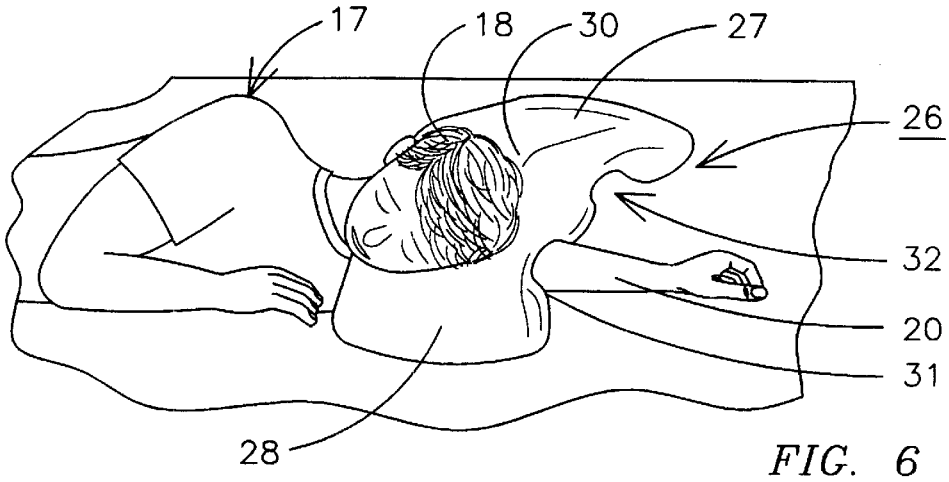
FIG. 6 is a perspective view of a person resting on the pillow of FIGS. 4 and 5.

Turning to FIGS. 4–6, a second embodiment of a pillow 26 is illustrated having angled surfaces 27 and 28 joined by arcuate surface 30 on the top thereof and having openings 31 and 32 for an individual's arm to pass through. This pillow is a more free-form version of the pillow of FIGS. 1–3 and has the angled surfaces 27 and 28 positioned at about 45 degrees with the arm openings 31 and 32 placed in a position to hold the arms to force the head of the patient in a downwardly position on the angled sides 27 or 28.

In FIG. 6, the individual 17 is illustrated with his arm 20 extending through the opening 31 while his head 18 rests on the angled surface 28. As seen in FIG. 5, the arm openings are positioned at an angle for an individual's arm to rest in a comfortable position on the one hand and to help maintain the individual's head 18 in the proper position on the resting surface 27 or 28.

As seen in FIGS. 1 and 4, the angled sides diverge downwardly, at a predetermined angle, from a raised, apex-like area.

It should be clear at this time that a sleep apnea avoidance process and apparatus have been provided which advantageously holds a person's head in a proper position to prevent the jaw from moving backward while holding the head in the position without restraints other than the positioning of the arm in an arm opening. However, the present invention is not to be construed as limited to the forms shown herein which are to be considered illustrative rather than restrictive.

I claim:

1. A sleep apnea avoidance process comprising the steps of:

selecting a pillow having two angled sides angled at a predetermined angle diverging downwardly from raised apexlike area, and shaped to hold a person's head face down thereon, said pillow having two generally parallel arm openings thereunder for a person's arm positioned to assist in holding the person's head face down on a pillow angled side; and resting on said pillow angled pillow face down with an arm positioned in an arm opening whereby jaw movement and sleep apnea are avoided.

2. The sleep apnea avoidance process in accordance with claim 1, wherein one arm openings is adapted to hold an arm when a person is laying on one angled side of said pillow and the other arm openings is adapted to hold an arm when a person is laying on the other angled side.

3. A sleep apnea avoidance pillow comprising:

a pillow having at least two angled sides angled at a predetermined angle diverging downwardly from a raised apexlike area, and shaped to hold a person's head face down thereon, said pillow having two generally parallel arm accommodating openings thereunder for a person's arm, one said arm opening being positioned to hold a person's arm when the person is laying on one angled side of said pillow and the other positioned to hold a person's arm when a person is laying on the other angled side of said pillow whereby jaw movement and sleep apnea are avoided in a person resting on said pillow.

* * * * *